US006385909B1

(12) United States Patent
Marsh et al.

(10) Patent No.: US 6,385,909 B1
(45) Date of Patent: May 14, 2002

(54) LOCKABLE, CAMMED DOOR FLAP FOR PETS

(76) Inventors: Gary F. Marsh, 17516 Sarita Ave., Santa Clarita, CA (US) 91351; Steven J. Clayden, 402 E. Melody La., Gilbert, AZ (US) 85234

( * ) Notice: Subject to any disclaimer, the term of this patent is extended or adjusted under 35 U.S.C. 154(b) by 0 days.

(21) Appl. No.: 09/628,619

(22) Filed: Jul. 31, 2000

(51) Int. Cl.[7] ..... E05D 15/48
(52) U.S. Cl. ..... 49/169; 49/168; 49/386
(58) Field of Search ..... 49/172, 173, 181, 49/189, 190, 157, 261, 262, 381, 397, 398, 399, 168, 169; 292/37, 159, 182, 140

(56) References Cited

U.S. PATENT DOCUMENTS 2,293,363 A * 8/1942 Schell
3,978,616 A * 9/1976 Pennock ..... 49/386
4,347,502 A * 8/1982 Holmes et al. ..... 340/545
5,469,659 A * 11/1995 Reid et al. ..... 49/169
5,551,188 A * 9/1996 Davlantes ..... 49/169
5,701,702 A * 12/1997 Reid et al. ..... 49/169
5,872,516 A * 2/1999 Bonge, Jr. ..... 340/573

* cited by examiner

*Primary Examiner*—Curtis Cohen
(74) *Attorney, Agent, or Firm*—Pitts & Brittian, P.C.

(57) ABSTRACT

A pet door including a cammed closing mechanism and a sliding lock mechanism. The cammed closing mechanism returns the pet door to a resting closed position and provides sufficient force to resist opening by normal weather conditions such as wind or a hard rain without the need for additional components such as magnets. The sliding lock mechanism serves to control the ingress and/or the egress of an animal through the pet door as selected by the pet door owner.

19 Claims, 9 Drawing Sheets

LOCKABLE, CAMMED DOOR FLAP FOR PETS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

This invention relates to a device to allow pets to pass through a structural member such as a wall or a door. More specifically, this invention relates to a door insert flap having a cammed mechanism to provide pet access through a structural member.

2. Description of the Related Art

Pet doors are commonly used to allow a pet ingress or egress through a solid or semi-solid structural member such as a door or a wall. While varying in complexity, the overall goal of a pet door is to provide a controlled ingress and egress through a self-closing opening which is easily operable by a pet, yet has sufficient resistance to prevent opening due to wind and rain or other weather conditions. Prior art pet doors are known to have no locking mechanism and/or no mechanism to resist opening by the wind, or to have a multitude of parts to provide such features, thereby increasing the complexity and cost of such pet doors. Pet owners seek a simple and reliable pet door that can be installed quickly and easily and which allows controlled ingress and egress of a pet from an enclosure.

An example of the prior art is U.S. Pat. No. 5,406,748, issued to Davlantes, which discloses a vertically movable pet door flap apparatus including a frame element having a top frame portion, an opening in the frame enclosure, and a flap element that closes the opening. The flap top portion includes a horizontally extending pivot element for pivotably moving the flap in response to a horizontal force applied by an animal. The flap top portion includes a cam element that rotates the top frame portion during pivotal movement of the flap away from the generally vertical position of the flap. The flap top portion further includes a multi-component horizontally extending pivot means and a rotatable horizontal axial portion for pivotably moving the flap. The cam element is attached to the ends of the flap top portion and includes a cam assembly defining an aperture, a slot in the cam element, and a protrusion such as a flange for engagement with the horizontally extending pivot means. The flap is tapered to be seated within the frame element when closed. The pet door also includes a locking element. The pet door flap apparatus requires a plurality of parts for proper operation of the cam element and cam assembly for opening and closing of the flap.

Therefore, it is an object of the present invention to provide a door flap apparatus to provide ease of entry and exit to an enclosure by an animal without having a multitude of complex parts for operation.

It is another object of the present invention to provide an apparatus with a self-closing door flap that is resistant to opening by wind or rain.

It is another object of the present invention to provide an apparatus with a self-sealing door flap having a cammed apparatus for rotation of the door flap.

It is another object of the present invention to provide a pet door flap apparatus that is manufactured with a minimum of parts.

BRIEF SUMMARY OF THE INVENTION

In accordance with the present invention, there is provided a pet door. The pet door includes a two-piece frame disposed on opposing faces of a door, or other structural member. The frame defines through-opening which bounded by a substantially U-shaped lip which extends through the door and which is closed by a pivotable flap.

The pivotable flap is maintained in a normally substantially closed position by a pair of cams members which terminate a pair of axial extensions defining the pivot axis of the flap along the top horizontal edge. Each cam member rests upon a horizontal shelf defined by the frame lip and defines a forward extent and rearward extent perpendicular to the face of the flap which, together with the weight of the flap, provides the resistive force to return the flap to a normally vertical closed position when undisturbed. Each extent has a bottom edge and front edge which are substantially flat and a rounded coming between the bottom edge and the front edge. The cam members and the flap do not allow incidental forces to overcome the resistance to pivoting, or the moment of inertia of the cam members and the flap. In this manner, the flap remains in a closed position without the need of sealing gaskets or magnetic devices as utilized in prior art pet doors.

The pet door of the present invention further includes a lock mechanism which provides control over the movement of the flap allowing the pet owner to limit ingress and/or egress as desired. The lock mechanism is contained within a lock enclosure which is attached to the frame. Housed within the lock enclosure are a locking tab positioner and a cooperating spring clip. Disposed on each end of the spring clip is one of a pair of locking tabs. The lock mechanism further includes a pair of locking tab recesses defined on opposing faces of the door flap for receiving the locking tabs. The locking tab recesses generally extend to a depth greater than half of the depth of the door flap to allow the locking tabs to independently or simultaneously engage the respective recess to prevent both ingress and egress without the need for movement of the door flap.

The lock mechanism operates by sliding the locking tab positioner within the lock mechanism enclosure. The locking tab positioner includes a fluctuating top surface which defines a series of peaks and valleys configured to cooperate with the locking tabs of the spring clip. The locking tabs are held against the positioner top surface by the downward force of the independent spring arms of the spring clip. The peaks are arranged such that one or both of the locking tabs are raised through the locking tab slots depending upon the relative position of the locking tab positioner within the locking mechanism enclosure. Similarly, the valleys are arranged such that one or both of the locking tabs do not extend through the locking tab slots depending upon the relative position of the locking tab positioner within the locking mechanism enclosure.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

In accordance with the present invention, there is provided a pet door flap apparatus that is insertable into a door of an enclosure for allowing access by animals through a closed door. The pet door flap apparatus, or pet door 10, incorporates various features as illustrated generally in FIGS. 1–11.

Figure 1:
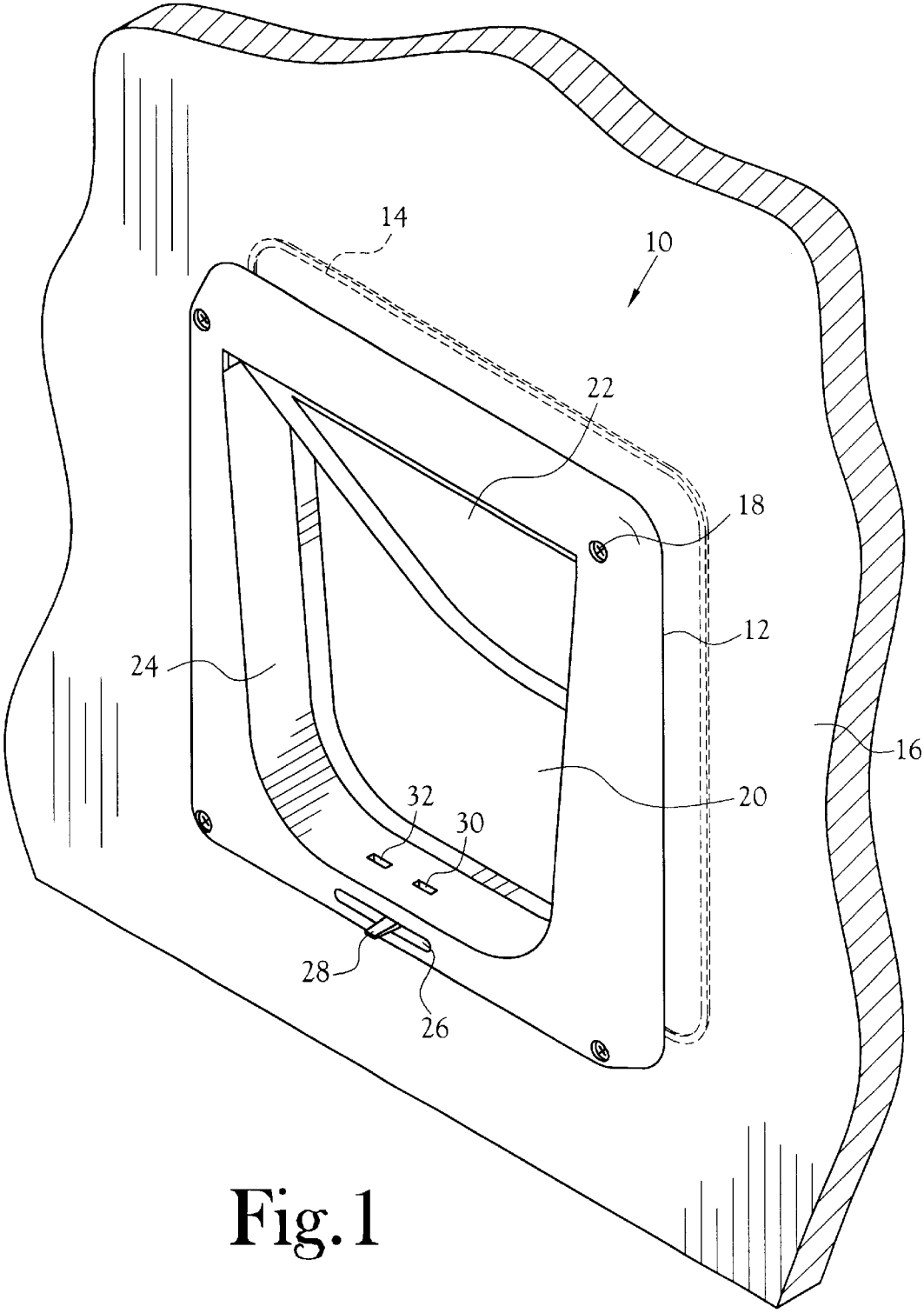
FIG. 1 is a front perspective view of a pet door in accordance with the present invention.

FIG. 1 illustrates a front perspective view of one embodiment of the apparatus 10 including a first frame member 12 connected to a second frame member 14 disposed on opposing faces of a door 16, or other structural member. The frame members 12, 14 are positioned around a pre-cut opening and held in place via fasteners 18. Each frame member 12, 14 defines a cooperating through-opening 20 which coincides with the pre-cut opening in the door 16 and receives a flap 22. The first frame member 12 further defines a substantially U-shaped lip 24 which extends through the door 16 to enclose the through-opening thereby permitting use in semi-solid structural members such as a hollow-core door. Additionally, the first frame member 12 defines an elongated vertical slot 26 within which is disposed a lever 28 controlling the operation of a locking mechanism for limiting the movement of the flap 22. Finally, the frame lip defines a first locking tab slot 30 and a second locking tab slot 32 through which the locking tabs (not shown) pass for limiting the movement of the flap 22. In the illustrated embodiment, the frame members 12, 14 are generally rectangular; however, those skilled in the art will recognize that other shapes may be used without interfering with objects and advantages of the present invention.

Figure 2:
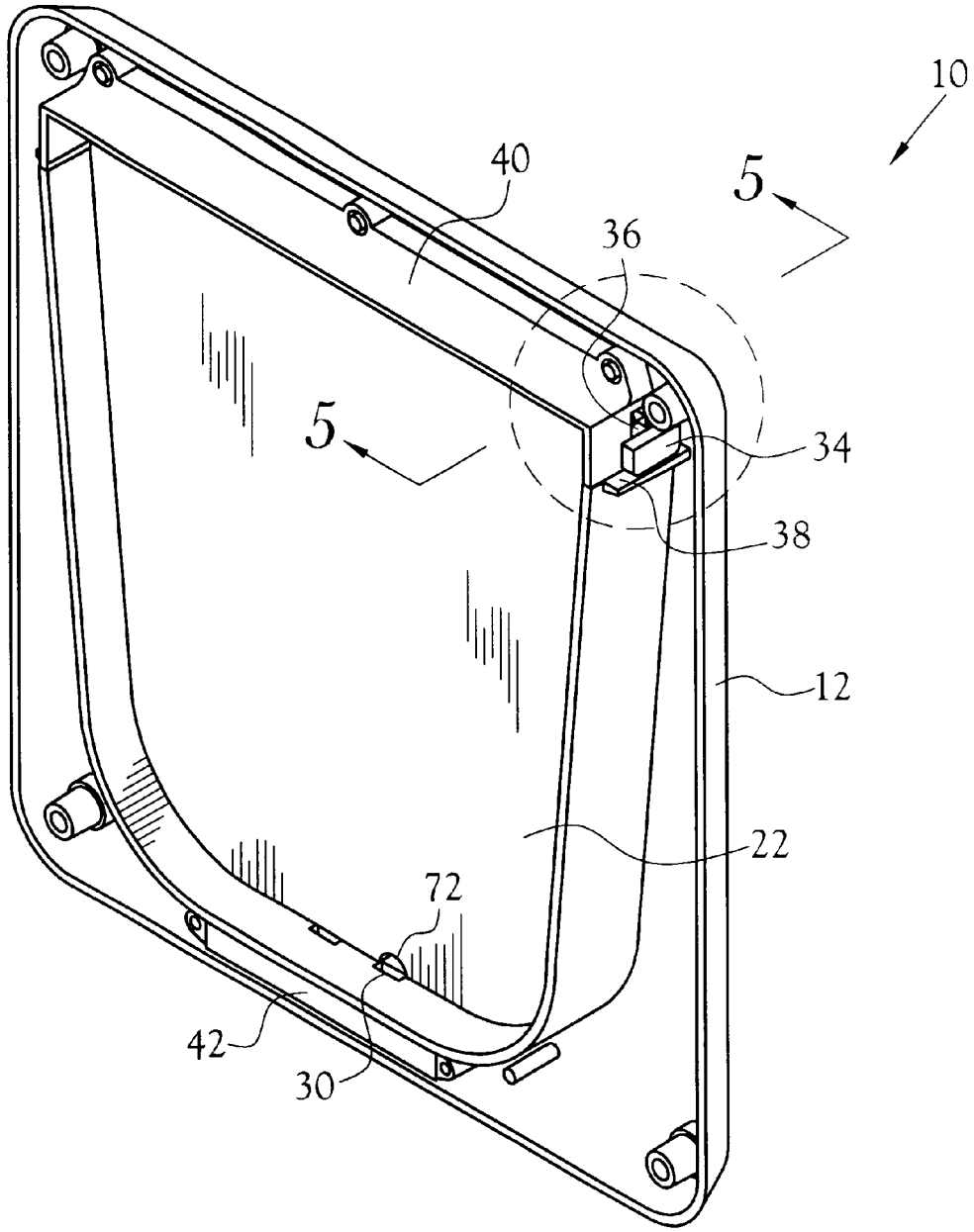
FIG. 2 is a rear perspective view of the interior of a first frame member of the pet door of FIG. 1, illustrating a pet door flap installed therein.

FIG. 2 is a rear perspective view of the first frame member 12 illustrating the novel operation of the flap 22. The flap 22 is dimensioned so as to substantially span the through-opening 20 of the frame 12 and defines a pair of cam members 34 terminating a pair of axial extensions 36 which define the pivot axis 62 of the flap 22 along the top horizontal edge. Each cam member 34 rests upon a horizontal shelf 38 defined by the frame lip 24. In the illustrated embodiment, the flap 22 is retained by a bracket 40 which is releasably attached to the first frame member 12. An enclosure 42 disposed below the lower edge of the U-shaped lip 32 houses a locking mechanism (not shown).

Figure 3:
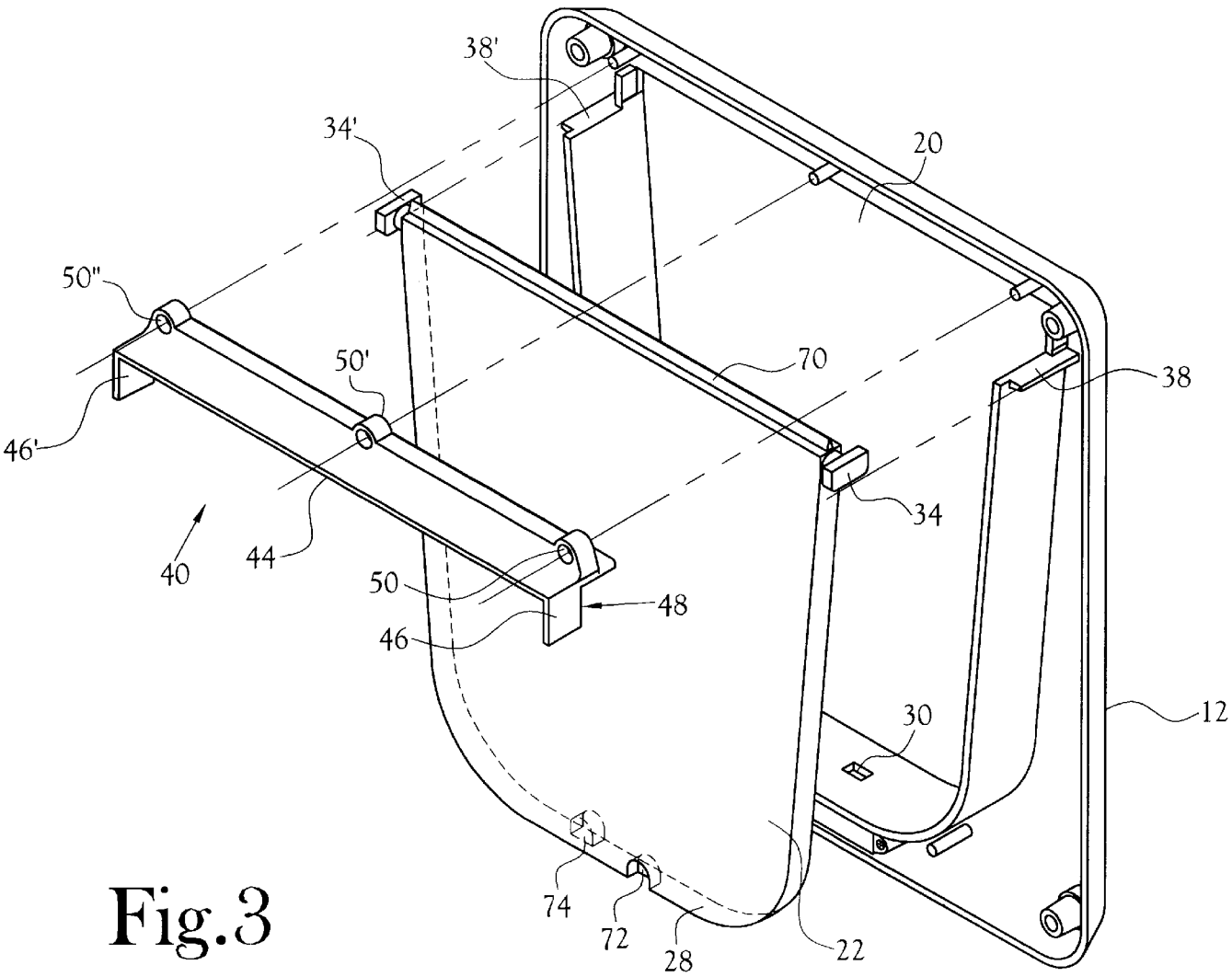
FIG. 3 is an exploded view of the assembly of the flap capture bracket, the door flap, and the first frame member of the present invention.

FIG. 3 illustrates an exploded view of the flap 22 in relation to the first frame member 12. The flap 22 is retained in position within the first frame member 12 by the retention bracket 40. The bracket 40 defines a horizontal lip 44 and a pair of vertical flaps 46 disposed downwardly from the opposing ends of the horizontal lip 44. When assembled, the bracket 40 and the frame lip 24 cooperate to form a substantially continuous surface bounding the through-opening 20. In the preferred embodiment, each flap 46 is configured in an inverted L-shape and defines a notch 48 at the bottom inner coming for receiving the axial extension 36 of the flap 22. In this manner, the flap 22 is secured within the pet door 10 by the inner surface of the first frame member 12, the shelves 38, and the bracket flaps 46. The flaps 46 limit the lateral movement while allowing the rotation of the axial extensions 36. In the illustrated embodiment, the bracket 40 defines a plurality of spaced connector openings 50 that are integrally formed transversely through the bracket 40 for receiving any of a number of fixed or releasable fasteners known to those skilled in the art in order to secure the bracket 40 to the interior of the first frame member 12.

FIG. 3 also illustrates includes a top edge seal 70. In order to allow room for pivoting, the top edge of the flap 22 does not come in direct contact with the horizontal bracket lip 44. The top edge seal 70 serves to minimize the air flow through this gap and to limit the passage of rain or other weather conditions. In the illustrated embodiment, the top edge seal 70 is a substantially triangular projection which extends upwardly from the top edge of the flap 22 to an apex in which engages the horizontal bracket lip 44 when the flap 22 is in the normal closed position. Those skilled in the art will recognize that other types of seals, including a pliable, rubber or soft plastic raised seal may also be used without interfering with the objects and advantages of the present invention.

Figure 4:
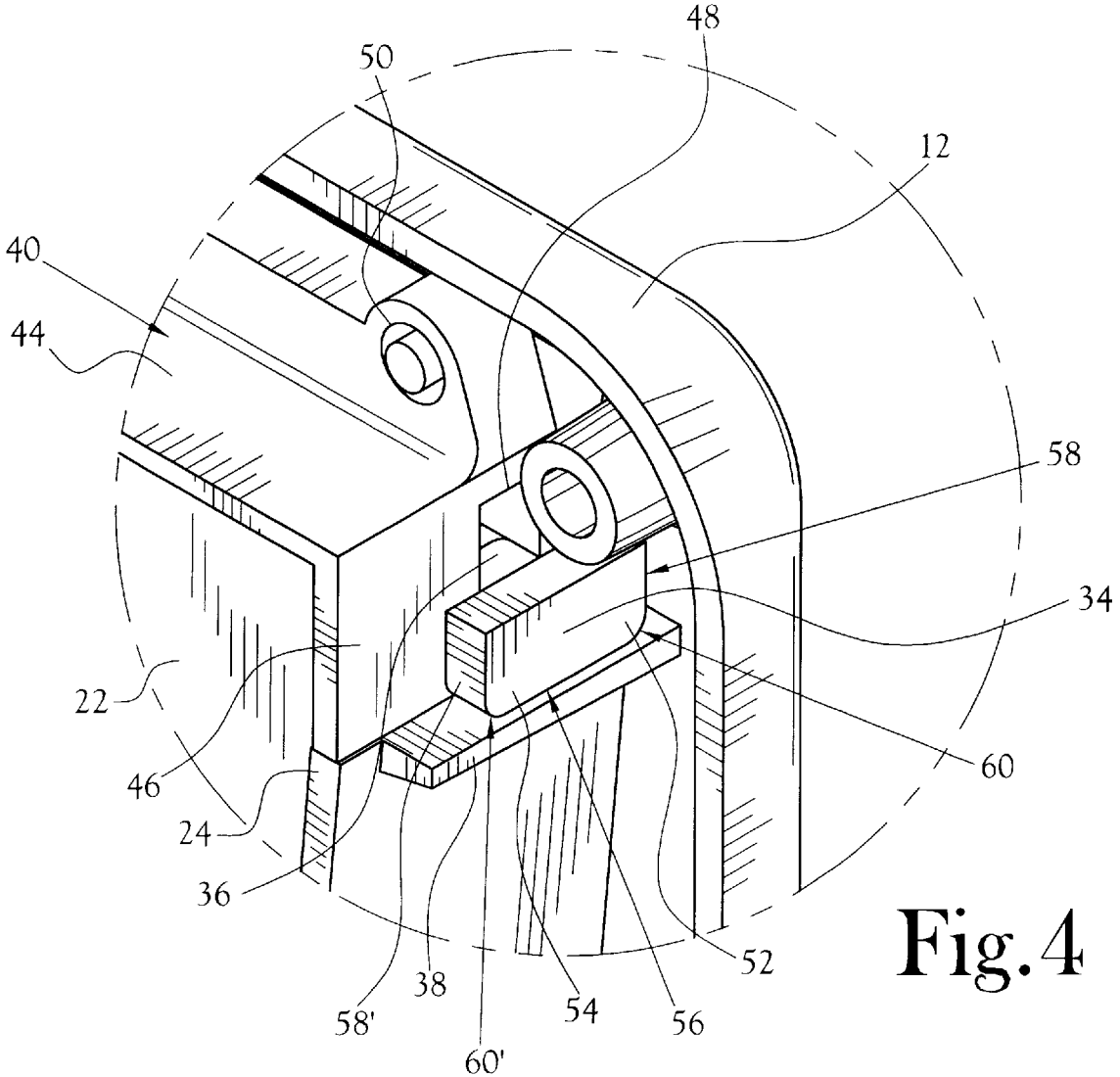
FIG. 4 is an enlarged rear perspective view of one upper corner of the pet door flap of FIG. 2, illustrating the right cam end extension inserted into the upper right corner of the interior frame inset, with the flap in a closed position.

FIG. 4 illustrates a enlarged view of one of the pair of cam members 34 with the flap 22, the bracket 40, and the first frame member 12 assembled. As previously noted, each cam member 34 rests upon the corresponding horizontal shelf 36 defined by the frame lip 24. Each cam member 34 is generally rectangular and defines a forward extent 52 and a rearward extent 54 perpendicular to the face of the flap 22 which, together with the weight of the flap 22, provides the resistive force to return the flap 22 to a normally vertical closed position when undisturbed. Each extent 52, 54 has a bottom edge 56 and a front edge 58 which are substantially flat and a chamfered corner 60 between the bottom edge 56 and the front edge 58. The cam members 34 and the flap 22 are selected so as not allow incidental forces to overcome the resistance to pivoting. Specifically the moment of inertia of the cam members 34 and the flap 22 provide an improved combination to maintain the flap 22 in a closed position within the through-opening 20 without the need of sealing gaskets or magnetic devices as utilized in prior art pet doors.

Figure 5A:
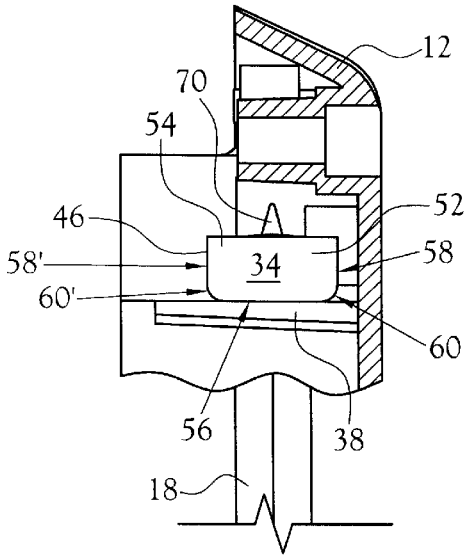
FIG. 5*a* is a right side elevation view, in partial section taken along lines 5—5 of FIG. 2, of the right cam member with the flap in a neutral position.
Figure 5B:
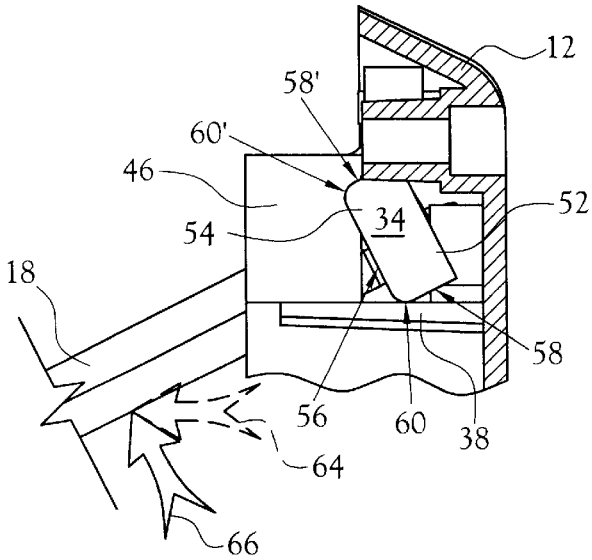
FIG. 5*b* is the sectional right side elevation view of FIG. 5*a* showing the cam member position at the initiation of the flap opening.
Figure 5C:
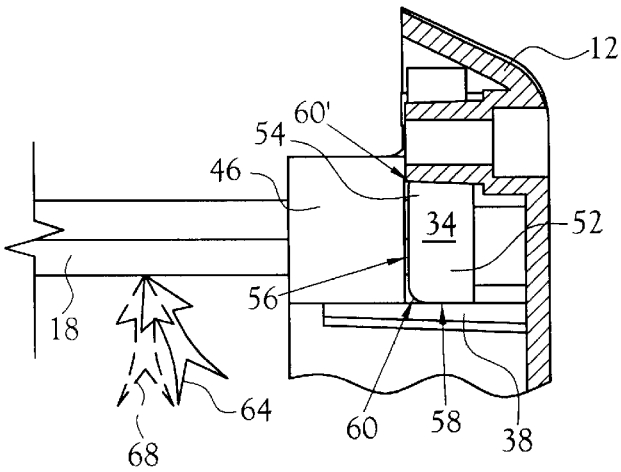
FIG 5*c* is the sectional right side elevation view of FIG. 5*a* showing the cam member position the flap fully open.

FIGS. 5*a*–5*c* illustrate a right side elevation view, in partial section, of the first frame member 12 focusing on the operation of the cam member 34. Specifically, FIG. 5*a* illustrates the cam member 34 in an resting position with the flap 22 acted upon only by the vertical force of gravity. The cam member bottom edge 56 statically rests flush against the shelf 38. When a force 64 having a substantially horizontal component 66 is applied, as in FIG. 5*b*, the flap 22 attempts to pivot around the pivot axis 62. If the horizontal force 66 is sufficient to overcome the moment of inertia created by the flap 22 and appropriate extent, in the illustrated case the forward extent 52, the cam member rolls on the rounded corner 60. As the force 64 continues, a vertical component 68 combined with the horizontal component 66, moves the flap 22 to the fully open position illustrated in FIG. 5*c* with the cam member front edge 58 resting flush against the shelf 38. When the force 64 is removed, the gravitational force returns the flap 22 to the vertical, normally closed position without the need for sealing gaskets, weights, or magnets utilized in prior art pet doors. Those skilled in the art will recognize that the length of the extents 52, 54 is generally selected such that, together with the weight of the flap 22, a sufficient moment of inertia is created to resist the forces likely to be associated with normal weather conditions, such as wind.

In the preferred embodiment, the components of the pet door 10, including the frame members 12, 14 and the flap 22, are constructed of rigid, light weight materials such as plastic. Those skilled in the art will recognize that other suitable materials such as a heavy gage rubber that generally maintain their shape can be used without interfering with the objects and advantages of the present invention.

Figure 6:
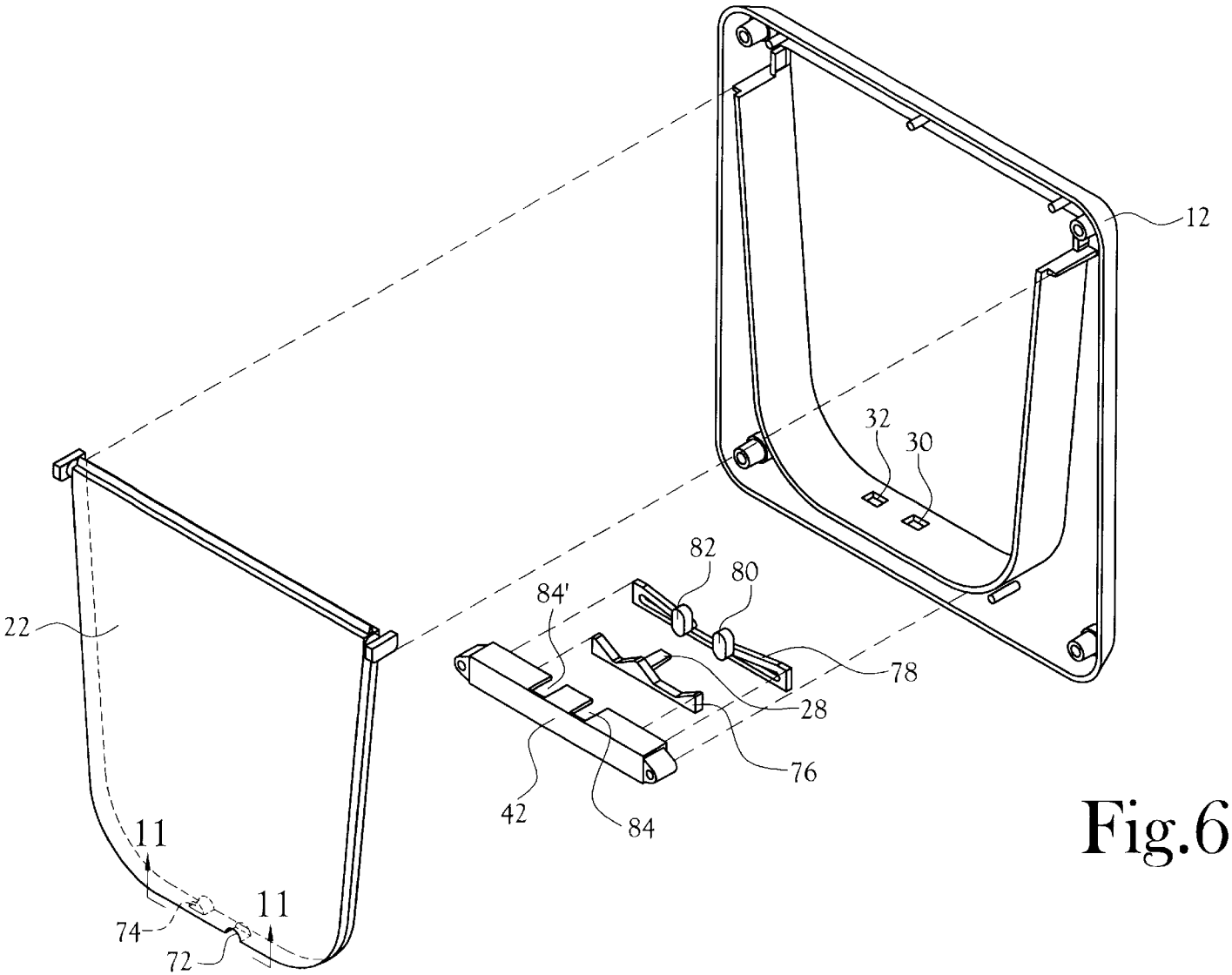
FIG. 6 is a exploded perspective view of the locking mechanism in relation to the first frame member.

The pet door 10 of the present invention includes a lock mechanism 71 which provides control over the movement of the flap 22 allowing the pet owner to limit ingress and/or egress as desired. FIG. 6 illustrates an exploded view of the lock mechanism 71 as it relates to the first frame member 12. The lock mechanism 71 is contained within the lock enclosure 42 which is attached to the first frame member 12. Housed within the lock enclosure 42 are a locking tab positioner 76 and a cooperating spring clip 78. Disposed on each end of the spring clip 78 is one of a pair of locking tabs 80, 82. Each locking tab 80, 82 is configured to be received by a corresponding tab notch 84, 84' of the lock enclosure 42 and the corresponding tab slot 30, 32 of the first frame member 12. The lock mechanism 71 further includes a pair of locking tab recesses 72, 74 defined on opposing faces of the door flap 22 for receiving the locking tabs 80, 82, respectively.

Figure 7:
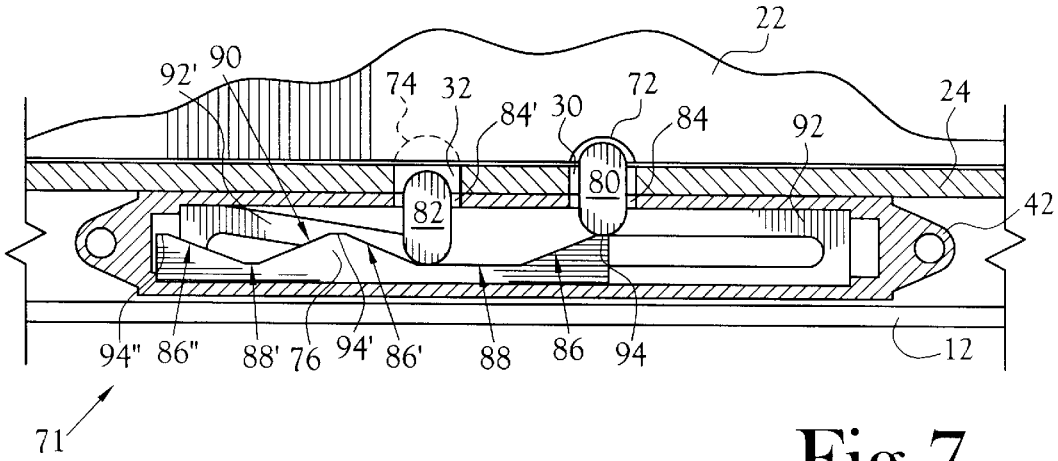
FIG. 7 is front plan view, in section, of the locking mechanism positioned to prevent ingress through the pet door.
Figure 8:
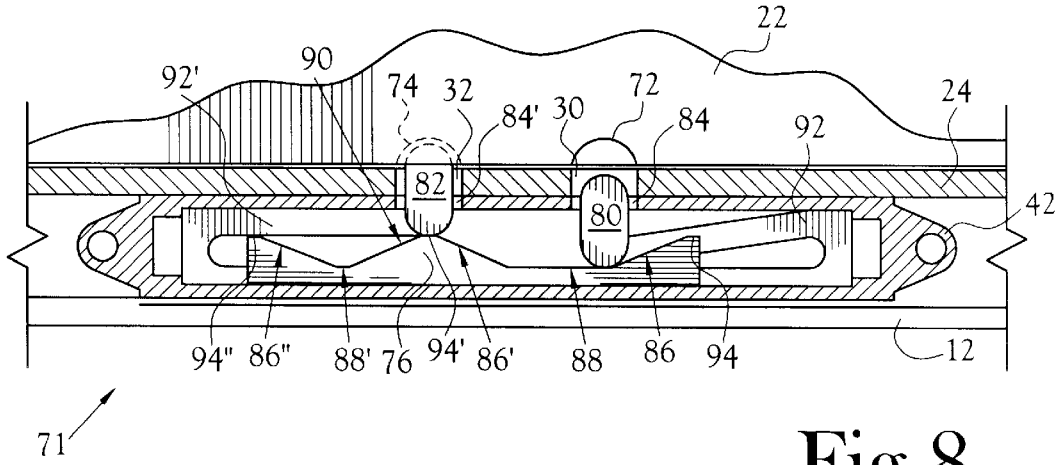
FIG. 8 is front plan view, in section, of the locking mechanism positioned to prevent egress through the pet door.
Figure 9:
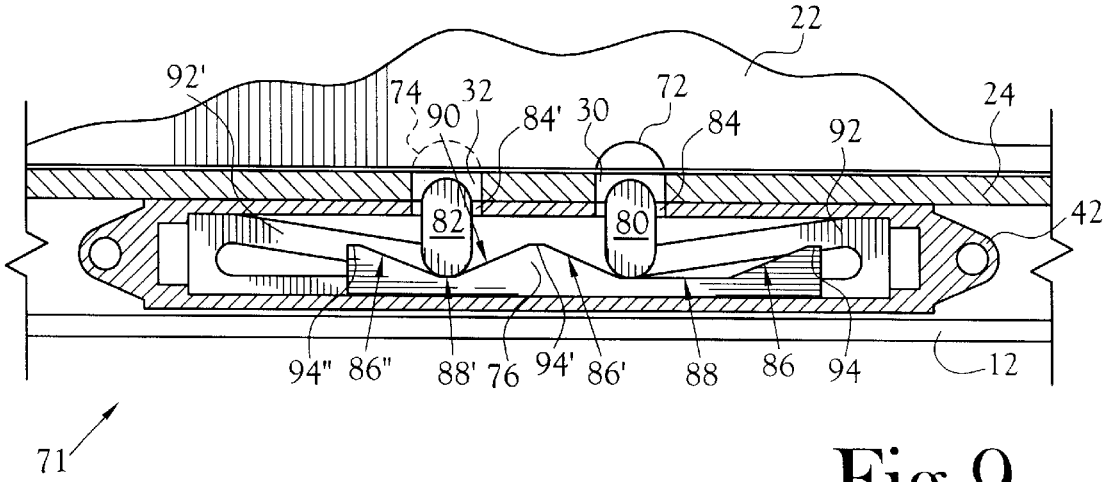
FIG. 9 is front plan view, in section, of the locking mechanism positioned to allow both ingress and egress through the pet door.
Figure 10:
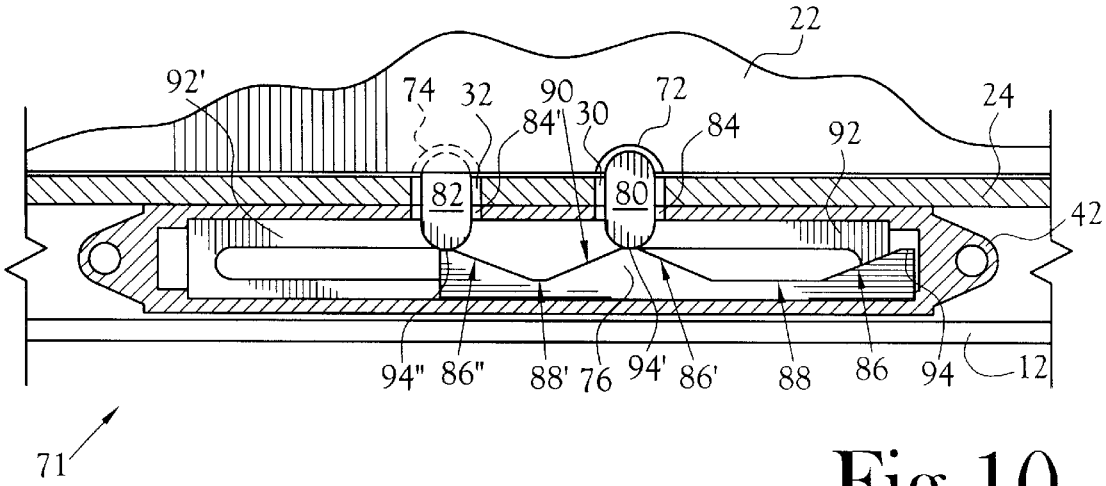
FIG. 10 is front plan view, in section, of the locking mechanism positioned to prevent both ingress and egress through the pet door.

FIGS. 7–10 illustrate the operation of the lock mechanism 71. Specifically, FIG. 7 is an enlarged sectional view of the lock mechanism 71 positioned to prevent ingress, FIG. 8 is the lock mechanism 71 positioned to prevent egress, FIG. 9 shows the lock mechanism 71 positioned to allow both ingress and egress, and FIG. 10 illustrates the lock mechanism 71 positioned to prevent both ingress and egress.

The lock mechanism 71 operates by sliding the locking tab positioner 76 within the lock mechanism enclosure 42 using the lock lever 28 (visible in FIGS. 1 and 6). The locking tab positioner 76 includes a fluctuating top surface 90 which defines a series of peaks 86 and valleys 88 configured to cooperate with the locking tabs 80, 82 of the spring clip 78. The locking tabs 80, 82 are held against the positioner top surface 90 by the downward force of the independent spring arms 92, 92' of the spring clip 78. The peaks 86 are selected to have sufficient height such that one or both of the locking tabs 80, 82 are raised through the locking tab slots 30, 32 depending upon the relative position of the locking tab positioner 76 within the locking mechanism enclosure 42. Similarly, the valleys are selected to be shallow enough such that one or both of the locking tabs 80, 82 do not extend through the locking tab slots 30, 32 depending upon the relative position of the locking tab positioner 76 within the locking mechanism enclosure 42. In the preferred embodiment, the apex of each peak defines a receptor 94 conforming to the shape of the bottom edge of the locking tabs 80, 82 to securely engage the locking tabs 80, 82 when in the raised position. Those skilled in the art will recognize that other means for securing the locking tabs can be used without interfering with the objects and advantages of the present invention.

Figure 11:
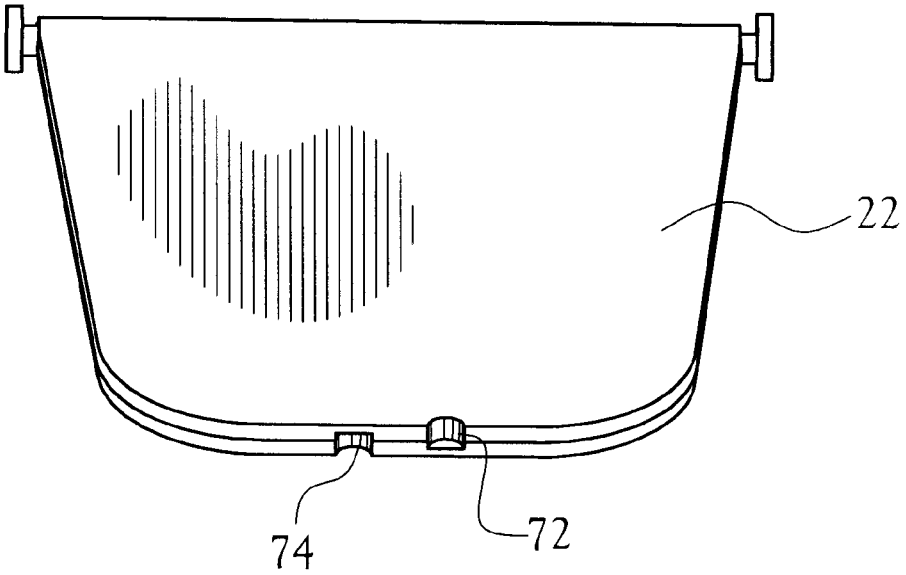
FIG. 11 is a perspective view of the door flap illustrating the configuration of the locking tab recesses.

FIG. 11 is a perspective view of the door flap 22 clearly illustrating the arrangement of the locking tab recesses 72, 74. As previously mentioned, each locking tab recess 72, 74 is defined on the opposing faces of the door flap 22. Further the locking tab recesses 72, 74 extend to a depth greater than half of the depth of the door flap 22. In this manner, the locking tabs 80, 82, which are centrally disposed with respect to the depth of the door flap 22, may simultaneously engage the respective recess to prevent both ingress and egress without the need for movement of the door flap 22. Generally, the first recess 72 is configured to receive the first locking tab 80 thereby preventing ingress when engaged while the second recess 74 is configured to receive the second locking tab 82 thereby preventing egress while engaged.

Accordingly, there has been described a pet door including a cammed closing mechanism for returning the pet door to a resting closed position and providing sufficient force to resist opening by normal weather conditions such as wind or a hard rain without the need for additional components such as magnets. Further, the pet door of the present invention teaches a sliding lock mechanism which serves to control the ingress and/or the egress of an animal through the pet door as selected by the pet door owner. From the foregoing description, additional advantages will be recognized by those skilled in the art of pet doors.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, we claim:

1. A pet door comprising:

a frame defining a through-opening and a cam shelf;

a flap pivotally connected to said frame within said through-opening, said flap being configured to cover a substantial portion of said through-opening; and a pair of cams connected to said flap and resting above said cam shelf, said pair of cams being configured to maintain said flap in a substantially closed orientation absent external forces thereon, said cams requiring a predetermined force to be applied to said flap to pivot said flap to an open orientation.

2. The pet door of claim 1 wherein each of said pair of cams is generally rectangular and defines a forward extent and a rearward extent, each of said forward extent and said rearward extent being perpendicular to a face of said flap.

3. The pet door of claim 2 wherein each of said forward extent and said rearward extent defines a bottom edge and a front edge which are substantially flat, said bottom edge engaging said cam shelf when said flap is in the substantially closed orientation and said front edge engaging said cam shelf when said flap is in the open orientation.

4. The pet door of claim 2 wherein each of said forward extent and said rearward extent further defines a chamfered corner between said bottom edge and said front edge, said chamfered corner reducing said predetermined force required to overcome an initial moment of inertia when said flap is in the substantially closed orientation.

5. A pet door comprising:

a frame defining a through-opening and a pair of locking tab slots;

a flap received within said through-opening, said flap being configured to cover a substantial portion of said through-opening, said flap defining a pair of locking tab recesses configured to cooperate with said pair of locking tab slots;

a locking tab positioner defining a top surface of fluctuating height;

a pair of locking tabs configured to cooperate with said pair of locking tab slots;

a spring clip including a pair of spring arms, one of said pair of locking tabs disposed on each of said pair of spring arms, said pair of spring arms providing a downward force holding each of said pair of locking tabs against said fluctuating top surface; and a lever for sliding said locking tab positioner;

whereby movement of said locking tab positioner raises and lowers each of said pair of locking tabs along said fluctuating top surface to engage and disengage from said locking tab recesses as desired thereby controlling ingress and egress through said pet door.

6. The pet door of claim 5 wherein said locking tab positioner top surface defines at least one peak and at least one valley, said at least one peak being of a predetermined height to raise either of said pair of locking tabs through a corresponding one of said pair of locking tab slots so as to engage a corresponding one of said pair of locking tab recesses and said at least one valley being of a predetermined height such that either of said pair of locking tabs does not engage a corresponding one of said pair of locking tab recesses.

7. The pet door of claim 5 wherein said pair of locking tab recesses are disposed upon opposing-faces of said flap, each of said pair of locking tab recesses having sufficient depth so as to allow each of said pair of locking tabs to engage a corresponding one of said pair of locking tab recesses when said flap is in a substantially closed orientation.

8. The pet door of claim 5 wherein said locking tab positioner is slidable with respect to said pair of locking tabs allowing said pair of locking tabs to be raised or lowered in relation to said fluctuating top surface whereby ingress and egress through said pet door is controlled.

9. The pet door of claim 5 wherein each of said pair of locking tabs is individually positionable allowing selective engagement of said pair of locking tab recesses such that when a first of said pair of locking tabs engages a first of said locking ingress is restricted while egress is permitted, when a second of said pair of locking tabs engages a second of said locking egress is restricted while ingress is permitted, when both of said pair of locking tabs engages one of said locking ingress and egress are restricted, and when neither of said pair of locking tabs engages one of said locking ingress and egress are permitted.

10. The pet door of claim 5 wherein said at least one peak defines a receptor configured to securely engage a bottom surface of either of said pair of locking tabs.

11. A pet door comprising:

a frame defining a through-opening, a pair of locking tab slots, and a cam shelf;

a flap received within said through-opening, said flap being configured to cover a substantial portion of said through-opening, said flap defining a pair of locking tab recesses configured to cooperate with said pair of locking tab slots;

a pair of cams connected to said flap and resting on said cam shelf, said pair of cams being configured to maintain said flap in a substantially closed orientation absent external forces thereon and to require a predetermined force to pivot said flap to an open orientation;

a locking tab positioner defining a top surface of fluctuating height;

a pair of locking tabs configured to cooperate with said pair of locking tab slots;

a spring clip including a pair of spring arms, one of said pair of locking tabs disposed on each of said pair of spring arms, said pair of spring arms providing a downward force holding each of said pair of locking tabs against said fluctuating top surface; and a lever for sliding said locking tab positioner;

whereby movement of said locking tab positioner raises and lowers each of said pair of locking tabs along said fluctuating top surface to engage and disengage from said locking tab recesses as desired thereby controlling ingress and egress through said pet door.

12. The pet door of claim 11 wherein each of said pair of cams is generally rectangular and defines a forward extent and a rearward extent, each of said forward extent and said rearward extent being perpendicular to a face of said flap.

13. The pet door of claim 12 wherein each of said forward extent and said rearward extent defines a bottom edge and a front edge which are substantially flat, said bottom edge engaging said cam shelf when said flap is in the substantially closed orientation and said front edge engaging said can shelf when said flap is in the open orientation.

14. The pet door of claim 12 wherein each of said forward extent and said rearward extent further defines a chamfered corner between said bottom edge and said front edge, said chamfered corner reducing said predetermined force required to overcome an initial moment of inertia when said flap is in the substantially closed orientation.

15. The pet door of claim 11 wherein said locking tab positioner top surface defines at least one peak and at least one valley, said at least one peak being of a predetermined height to raise either of said pair of locking tabs through a corresponding one of said pair of locking tab slots so as to engage a corresponding one of said pair of locking tab recesses and said at least one valley being of a predetermined height such that either of said pair of locking tabs does not engage a corresponding one of said pair of locking tab recesses.

16. The pet door of claim 11 wherein said pair of locking tab recesses are disposed upon opposing faces of said flap, each of said pair of locking tab recesses having sufficient depth so as to allow each of said pair of locking tabs to engage a corresponding one of said pair of locking tab recesses when said flap is in a substantially closed orientation.

17. The pet door of claim 11 wherein said locking tab positioner is slidable with respect to said pair of locking tabs allowing said pair of locking tabs to be raised or lowered in relation to said locking tab positioner top surface whereby ingress and egress through said pet door is controlled.

18. The pet door of claim 11 wherein each of said pair of locking tabs is individually positionable allowing selective engagement of said pair of locking tab recesses such that when a first of said pair of locking tabs engages a first of said locking ingress is restricted while egress is permitted, when a second of said pair of locking tabs engages a second of said locking egress is restricted while ingress is permitted, when both of said pair of locking tabs engages one of said locking ingress and egress are restricted, and when neither of said pair of locking tabs engages one of said locking ingress and egress are permitted.

19. The pet door of claim 11 wherein said at least one peak defines a receptor configured to securely engage a bottom surface of either of said pair of locking tabs.

* * * * *